US010188165B2

(12) United States Patent
Moreno, Jr.

(10) Patent No.: US 10,188,165 B2
(45) Date of Patent: Jan. 29, 2019

(54) HEADGEAR CONFIGURED FOR POSITIONING OF SPECTACLES

(71) Applicant: Saul D Moreno, Jr., Hebron, KY (US)

(72) Inventor: Saul D Moreno, Jr., Hebron, KY (US)

( * ) Notice: Subject to any disclaimer, the term of this patent is extended or adjusted under 35 U.S.C. 154(b) by 85 days.

(21) Appl. No.: 15/400,619

(22) Filed: Jan. 6, 2017

(65) Prior Publication Data

US 2017/0188645 A1 Jul. 6, 2017

Related U.S. Application Data

(60) Provisional application No. 62/275,278, filed on Jan. 6, 2016.

(51) Int. Cl.
*A42B 1/24* (2006.01)
*A42B 1/04* (2006.01)

(52) U.S. Cl.
CPC ..... *A42B 1/247* (2013.01); *A42B 1/041* (2013.01); *A42B 1/045* (2013.01)

(58) Field of Classification Search
CPC ..... A42B 1/066; A42B 1/041; A42B 1/046; A42B 1/247; A41D 2200/20
See application file for complete search history.

(56) References Cited

U.S. PATENT DOCUMENTS 2,262,142 A * 11/1941 Karmsen ..... A42B 1/247 2/10
4,179,753 A * 12/1979 Aronberg ..... A42B 1/247 2/10
5,388,269 A * 2/1995 Griffin ..... A61F 9/045 2/13
6,237,159 B1 * 5/2001 Martin ..... A42B 1/247 2/13
6,298,495 B1 * 10/2001 Totani ..... A42B 1/247 2/10
2007/0101480 A1 * 5/2007 Douglas ..... A42B 1/247 2/209.13
2016/0219963 A1 * 8/2016 Eklof ..... A42B 1/247

FOREIGN PATENT DOCUMENTS

JP WO 2012137357 A1 * 10/2012 ..... A42B 1/043

* cited by examiner

*Primary Examiner* — Tajash D Patel
(74) *Attorney, Agent, or Firm* — Witters & Associates; Steve Witters

(57) ABSTRACT

Technologies are described for methods and devices for positioning spectacles. The headgear has a first extending portion configured to extend under a chin, a second extending portion configured for extending about a forward portion of a head, and a third extending portion configured for extending about a reward portion of the head. A first opening is in the second extending portion or third extending portion and a second opening is in the second extending portion or third extending portion. The first opening is to receive a first eyeglass temple on a first side of the head and the second opening is configured and disposed to receive a second eyeglass temple on a second side of the head.

17 Claims, 10 Drawing Sheets

HEADGEAR CONFIGURED FOR POSITIONING OF SPECTACLES

RELATED APPLICATIONS

This application claims the benefit of U.S. Provisional Application Ser. No. 62/275,278, entitled "Headgear Configured for Positioning of Spectacles", filed Jan. 6, 2016, the entire contents of which is hereby incorporated by reference herein in its entirety.

FIELD OF THE DISCLOSURE

This disclosure relates generally to headgear configured for positioning of spectacles on a wearer.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

A desired positioning of spectacles may be needed to correct vision. Children and other individuals may have difficulty in positioning glasses or spectacles in a desired position. Upon correctly positioning of the spectacles, they may become disoriented or moved to an incorrect position. Maintaining desired or correct positioning of spectacles on a wearer may provide challenges. Some individuals may remove the spectacles upon disorientation, rather than repositioning them correctly.

It may be desired to hold the spectacles in a desired position with headgear. It may also be desirable to provide headgear that provides ease of repositioning spectacles upon becoming disoriented.

SUMMARY

Technologies are generally described for devices and methods for positioning spectacles. Headgear configured for positioning, or repositioning, of spectacles on a wearer is presently disclosed. For example, maintaining positioning of spectacles on a wearer may provide advantages in correction of vision.

In one aspect of the present disclosure, headgear configured for positioning of spectacles is provided. The headgear comprises a first extending portion configured to extend under a chin, a second extending portion configured for extending about a forward portion of a head, and a third extending portion configured for extending about a reward portion of the head. A first opening is in the second extending portion or third extending portion and a second opening is in the second extending portion or third extending portion. The first opening is configured and disposed to receive a first eyeglass temple on a first side of the head and the second opening is configured and disposed to receive a second eyeglass temple on a second side of the head.

In another aspect of the present disclosure a method for positioning and holding spectacles on the head is disclosed. The method comprises extending a first temple into a first opening in headgear configured to be held on the head. A second temple is extended into a second opening in the headgear. The headgear is slid onto the head and positioned to have a face opening about a face and each temple proximate an ear.

In a further aspect of the present disclosure, headgear configured for maintaining positioning, or inducing repositioning, of spectacles at a desired orientation on a wearer is disclosed. The headgear comprises a stretchable breathable material with a neck opening configured to enlarge by an amount sufficient for sliding the wearers head therein. A face opening is configured and disposed to extend about the wearer's face upon the wearer sliding their head into the neck opening. A first temple opening configured to receive a first temple and a second temple opening configured to receive a second temple is in the headgear. The first and the second temple openings are configured and disposed for positioning the spectacles at a desired orientation on the wearer.

The foregoing summary is illustrative only and is not intended to be in any way limiting. In addition to the illustrative aspects, embodiments, and features described above, further aspects, embodiments, and features will become apparent by reference to the examples and drawings and the following detailed description.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are; therefore, not to be considered limiting of its scope, the disclosure will be described with additional specificity and detail through use of the accompanying drawings.

The following figures, which are idealized, are not to scale and are intended to be merely illustrative of aspects of the present disclosure and non-limiting. In the drawings, like elements may be depicted by like reference numerals. The drawings are briefly described as follows.

DETAILED DESCRIPTION

Figure 1:
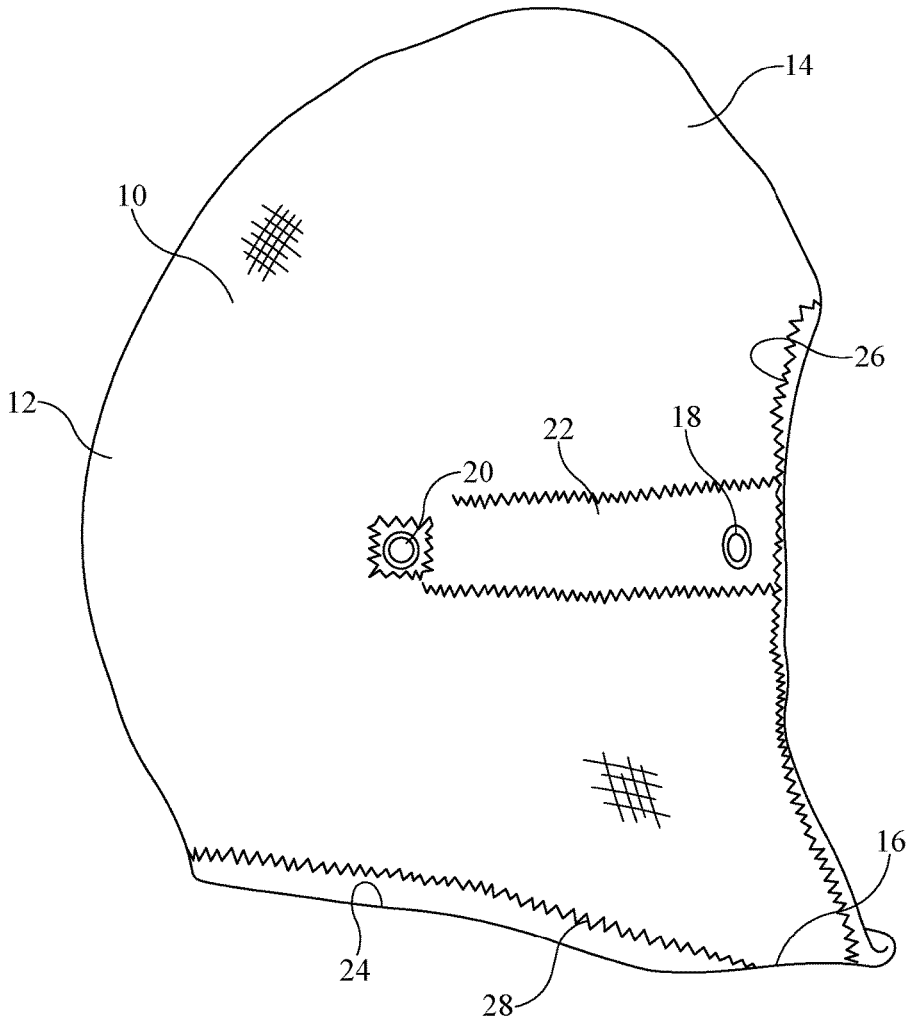
FIG. 1 is a side view of an embodiment of the headgear of the present disclosure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the figures, can be arranged, substituted, combined, separated, and designed in a wide variety of different configurations, all of which are explicitly contemplated herein.

Reference will now be made in detail to the present exemplary embodiments and aspects of the present invention, examples of which are illustrated in the accompanying figures. Wherever possible, the same reference numbers may be used throughout the figures to refer to the same or like parts.

Headgear of the present disclosure may provide accurate comfortable positioning for spectacles. For example, children or other individuals may desire positioning of spectacles to mitigate the displacement of spectacles or to keep spectacles in desired position.

The headgear of the present disclosure may be a spectacle holder wherein the temples of glasses may be inserted in slits, openings, or orifices in the headgear. For example, a temple may be inserted in a first opening from the outside near the temple area of the headgear and out a second opening located near the ear area of the headgear. Straps may be used to connect the temples of the glasses which may be installed after the glasses have been installed with the headgear. The headgear may then be put on the wearer's, for example a child's, head. Adjusting of the headgear may then be made to achieve the most comfortable position for the wearer.

Different materials may be used for making the headgear of the present disclosure. For example, a performance type knit fabric may be used and the headgear may be used to keep spectacles on babies or others. A knit fabric may allow for securing of spectacles so that when the wearer, child for example, moves the spectacles they may substantially stay in a desired location on the wearer. For example, rayon or nylon fabrics with a blend of Lycra or spandex in conjunction with a four way stretch may provide the headgear with desired spectacle positioning properties. Other desired properties may include comfort and breathability which may also be imparted to the headgear of the present disclosure.

Headgear of the present disclosure may comprise performance type knit material or other material. For example, rayon or nylon fabrics with a blend of Lycra or spandex in conjunction with a four way stretch or something similar may provide a comfortable and breathable headgear. Other materials as are known by persons having ordinary skill in the art may be used to make the headgear of the present disclosure having desired properties, for example, a net or perforated type of material having a plurality of openings may be used.

A use of the headgear of the present disclosure may be to provide a comfortable and secure way to keep spectacles in a desired or optimal position on a wearer, for example a child or other individual. Children from infancy and up, or others, may not keep spectacles in the correct position on their own. The headgear of the present disclosure may be formed in a way that it is skin tight around the wearer's head and may provide accurate positioning, substantially maintaining positioning, or induce correction of positioning by the wearer, of the spectacles on the wearer.

For example, spectacles may be prescribed by a doctor to help in correcting the vision of an individual. The spectacles may only correct the eyes of the individual if the spectacles are worn in a desired or prescribed position. For example, if eyeglasses or spectacles are not worn in a desired position, an individual may lose, or lessen, their 3D vision.

Other approaches for keeping spectacles in a desired position on a wearers head have been found inadequate. For example, the use of Band-Aids to associate the pain of removing, with removing of glasses, may not work as not all individuals experience a level of discomfort in removing the Band-Aids. Using a winter skull cap and using duct tape to keep glasses on it may cause the wearer discomfort, for example the wearer may get hot and may cause the wearer to pull off the cap and spectacles. A skull cap made of cotton and an athletic stretch tape may also cause a wearer to get too hot and pull off the headgear.

In at least one embodiment of the headgear of the present disclosure, a performance knit fabric like and under armor may be used to create a skin tight helmet. The helmet or headgear may have holes or openings that the eyeglasses temples may go through. The placement of the holes in the temple area may help secure the glasses on the wearer's face.

The headgear of the present disclosure may put the wearer on a corrective path to improve their eyesight. For example, a wearer may try to remove their glasses but may not be able. A wearer may move the glasses, by grabbing one side and either pull up or down, and the discomfort in the placement of the glasses and headgear may cause the wearer to reposition the glasses to a more comfortable and desired position.

FIG. 1 shows headgear 10 of the present disclosure. Headgear 10 may comprise a stretchable material with a face opening 26 and a neck opening 24. Headgear 10 may have a portion 16 for extending under the chin, a portion 14 for extending about an upper and/or forward portion of the head, and a portion 12 for extending about a lower and/or reward portion of the head.

Temple opening 18 and opening 20 may be configured and disposed to receive a temple of eyeglasses. For example, a temple of eyeglasses may be extended into temple opening 18 and out of opening 20. Sleeve 22 is optional and may be configured and disposed hold the portion of the temple of the eyeglasses that extends through temple opening 18 and opening 20. Stitching 28 may be used about face opening 26, neck opening 24, and/or optional sleeve 22.

In at least one embodiment, headgear 10 is configured for maintaining positioning, or inducing repositioning, of spectacles at a desired orientation on a wearer. Headgear 10 may comprise a stretchable breathable material with a neck opening 24 configured to enlarge by an amount sufficient for sliding the wearers head therein. Face opening 26 is configured and disposed to extend about the wearer's face upon the wearer sliding their head into the neck opening 24. First temple opening 18 is configured to receive a first temple and a second temple opening is configured to receive a second temple. The temple openings are configured and disposed for positioning the spectacles at a desired orientation on the wearer. Headgear 10 may have third temple opening 20 configured to receive the first temple and a fourth temple opening configured to receive the second temple, wherein second and fourth temple openings are on the side not shown in this view. For example, first and the third temple openings, 18 and 20, may be configured and disposed to hold the first temple above and proximate an ear and the second and the fourth temple openings may be configured and disposed to hold the second temple above and proximate the other ear, as shown in FIGS. 9-12.

Headgear 10 may be configured to induce the wearer to reposition the headgear and spectacles to a desired orientation upon the headgear and spectacles being positioned at an undesired orientation. For example, headgear 10 may be configured to become skin tight on the wearer's head. Headgear 10 may have a rear opening configured and disposed for hair to extend out of the headgear. Headgear 10 may have a chin strapping portion 16 configured to extend about a chin, a forward strapping portion 14 configured to extend about a forehead, and a rearward strapping portion 12 configured to extend about the rear of the head.

Figure 2:
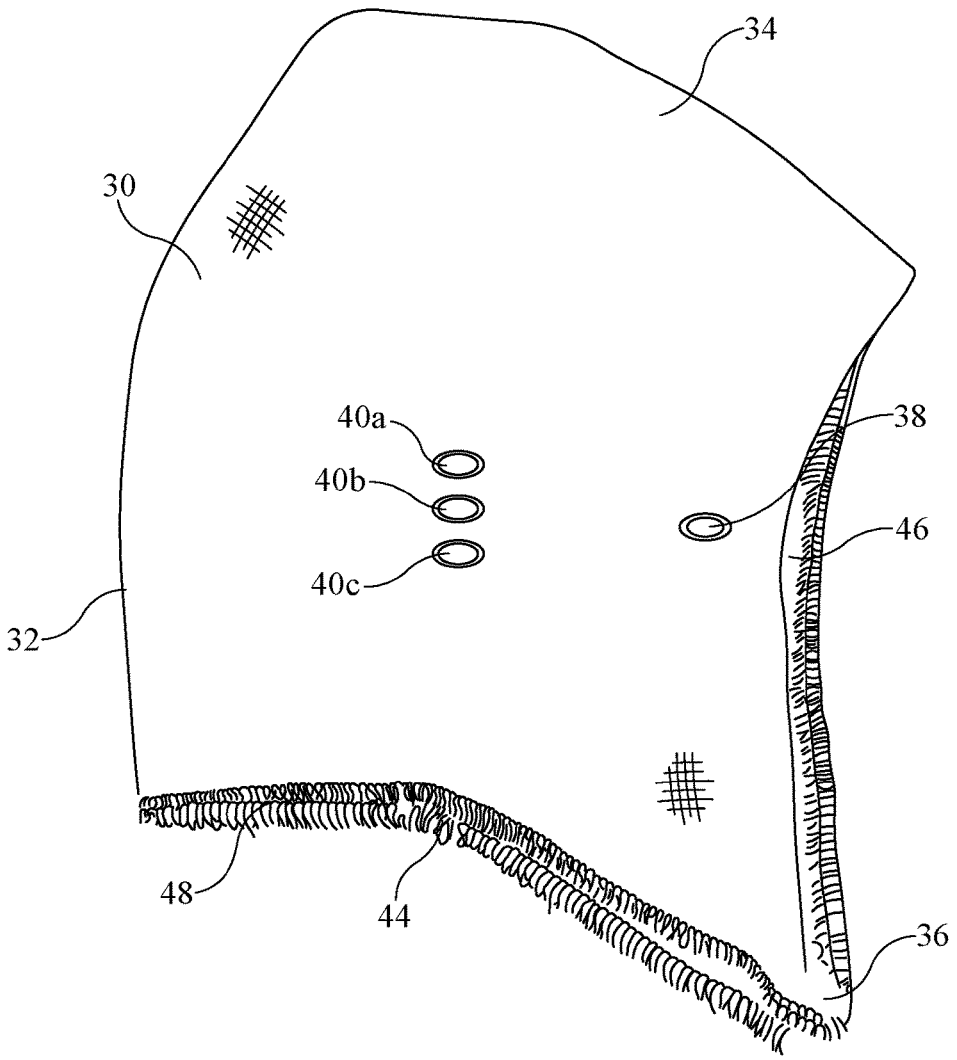
FIG. 2 is a side view of another embodiment of the headgear of the present disclosure.

FIG. 2 shows headgear 30 of the present disclosure. Headgear 30 may comprise a stretchable material with a face opening 46 and a neck opening 44. Headgear 30 may have a portion 36 for extending under the chin, a portion 34 for extending about an upper and/or forward portion of the head, and a portion 32 for extending about a lower and/or reward portion of the head.

Temple opening 38 and openings 40*a*, 40*b*, and 40*c* may be configured and disposed to receive a temple of eyeglasses. For example, a temple of eyeglasses may be extended into temple opening 38 and out of one of the openings 40*a*, 40*b*, and 40*c*. A plurality of rear openings, for example openings 40*a*, 40*b*, and 40*c*, may provide headgear 30 with additional positioning alternatives and may provide positioning of eyeglasses for different size wearers. Stitching 48 may be used about face opening 46, temple opening 38, openings 40*a*, 40*b*, and 40*c*, and/neck opening 44.

In at least one embodiment of the present disclosure, headgear 30 is configured for positioning of spectacles. Headgear 30 may comprise a first extending portion 36 configured to extend under a chin, a second extending portion 34 configured for extending about a forward portion of a head, and a third extending portion 32 configured for extending about a reward portion of the head. A first opening 38 is in second extending portion 34 or third extending portion 32 and a second opening (not shown as in side not shown in this view) in the second extending portion or third extending portion. First opening 38 is configured and disposed to receive a first eyeglass temple on a first side of the head and the second opening, on side not shown, is configured and disposed to receive a second eyeglass temple on a second side of the head. Headgear 30 may have a third opening, 40*a*, 40*b*, or 40*c*, and a fourth opening, on the side not shown. Third opening, 40*a*, 40*b*, or 40*c*, is spaced apart from first opening 38 and is configured and disposed to receive a first eyeglass temple on the first side of the head. The fourth opening is spaced apart from the second opening, openings on side of headgear not shown, are configured and disposed to receive the second eyeglass temple on the second side of the head. First opening 38 and third opening, 40*a*, 40*b*, or 40*c*, are spaced apart a distance less than a length of the first eyeglass temple and the second opening and the fourth opening are spaced apart a distance less than a length of the second eyeglass temple. First opening 38 and the third opening, 40*a*, 40*b*, or 40*c*, are configured and disposed to hold the first eyeglass temple proximate a first ear and the second opening and the fourth opening are configured and disposed to hold the second eyeglass temple proximate a second ear.

First extending portion 36, second extending portion 34, and the third extending portion 32 may be unitary and comprised of the same material. For example, headgear 30 may be made entirely of the same stretchable material. The stretchable material may be a four way stretch fabric. In at least one embodiment, wherein the material is breathable.

Headgear 30 may comprise a face opening 46 between first extending portion 36 and second extending portion 34 and neck opening 44 between first extending portion 36 and third extending portion 32.

Figure 3:
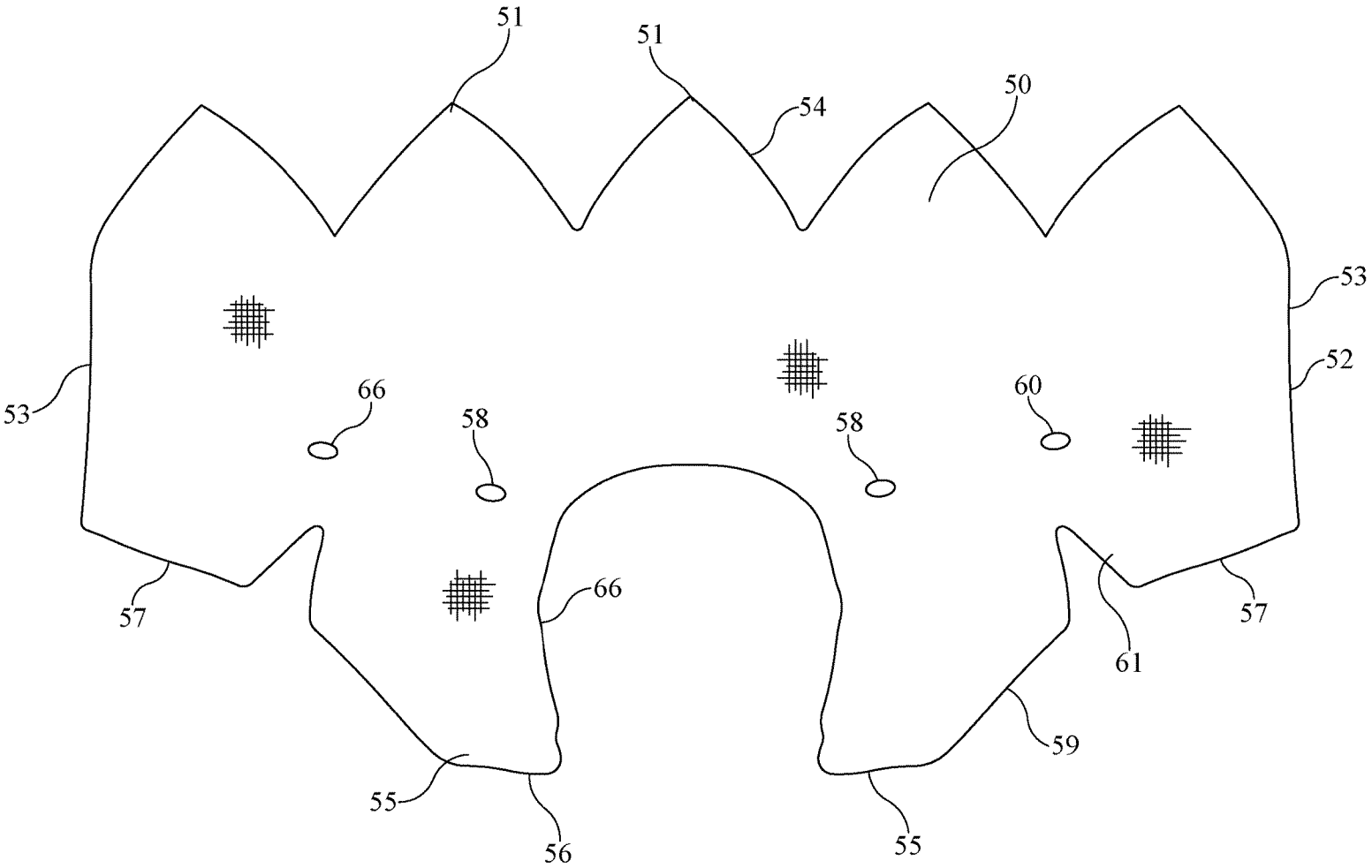
FIG. 3 shows material in a pattern for making an embodiment of headgear of the present disclosure.
Figure 4:
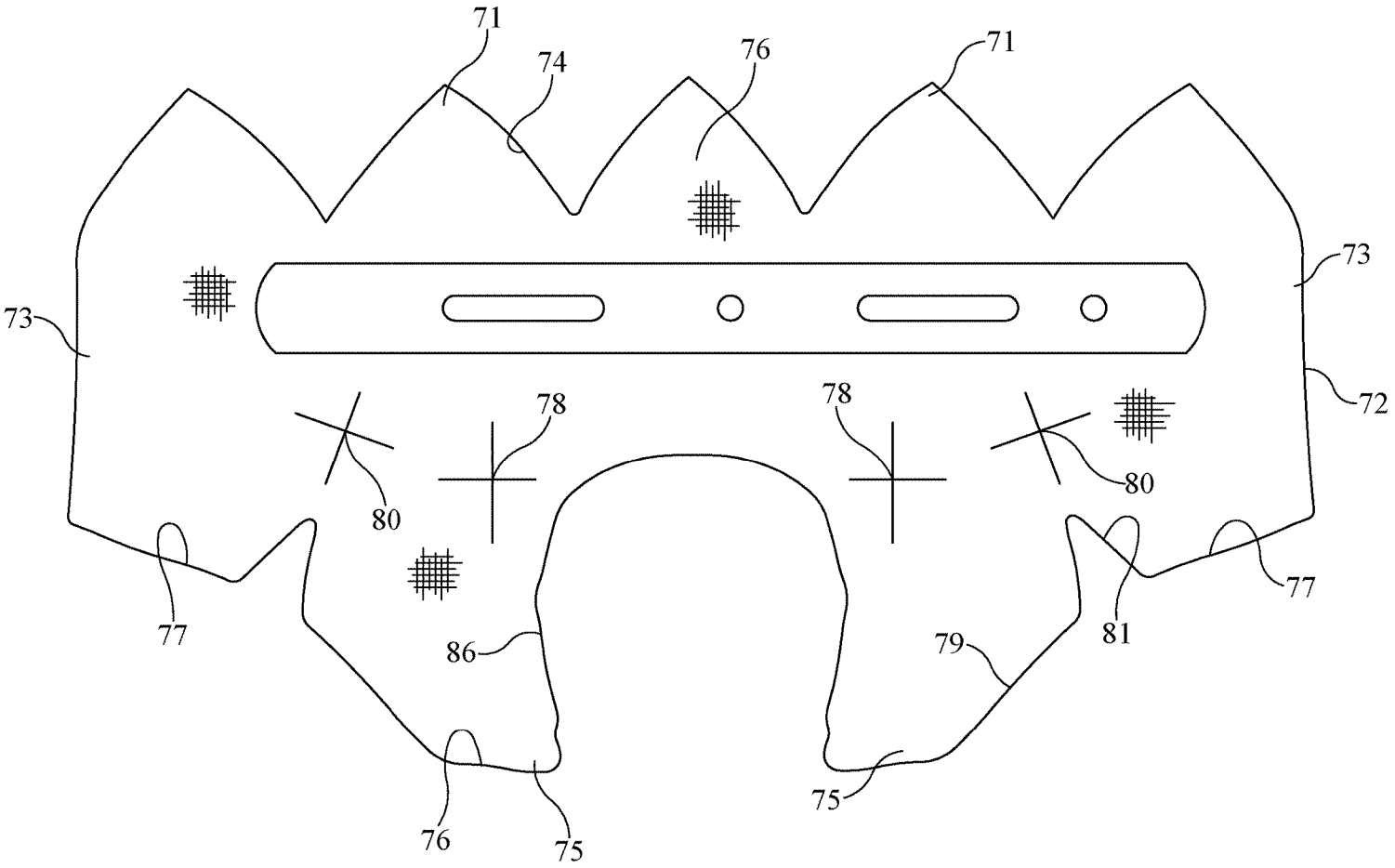
FIG. 4 shows material in a pattern with a measurement for making an embodiment headgear of the present disclosure.

FIGS. 3 and 4 show material in a pattern, 50 and 70 respectively, for making an embodiment of headgear of the present disclosure. For example, headgear 10 and/or headgear 30 may be constructed with patterned material 50. In construction of the headgear of the present disclosure, points 51 may be mated. The edges 54 of the material, extending to the points 51, may also be mated. Points 51 and edges 54 may then be joined, such as stitched, to form an upper portion of the headgear.

Edges 53 may be mated and joined. Edges 61 may be mated and joined. Edges 55 may be mated and joined to form a chin-strap like portion 56. Edge 66 may be configured and disposed to provide a face opening. Edges 57 and 59 may be configured and disposed to provide a neck opening. Temple openings 58 and openings 60 may be configured and disposed to provide openings for receiving the temples of eyeglasses. For example, a temple of eyeglasses may be extended into temple opening 58 and out of opening 60. In at least one embodiment, openings 58 are first and second openings, opening 60 is a third opening, and opening 66 is a fourth opening. Stitching may be used about the face opening and/or a neck opening as may be desired.

Headgear 10 and/or headgear 30 may be constructed with patterned material 70. In construction of the headgear of the present disclosure, points 71 may be mated. The edges of the material extending to the points, 74, may also be mated. Points 71 and edges 74 may then be joined, such as stitched, to form an upper portion of the headgear.

Edges 73 may be mated and joined. Edges 81 may be mated and joined. Edges 75 may be mated and joined to form a chin-strap like portion 76. Edge 86 may be configured and disposed to provide a face opening. Edges 77 and 79 may be configured and disposed to provide a neck opening. Temple opening positions 78 and opening positions 80 may be configured and disposed to provide for placement of openings for receiving the temples of eyeglasses. For example, a temple of eyeglasses may be extended into openings made at temple opening positions 78 and out of openings made at positions 80. In at least one embodiment, first and second openings are placed at positions 78 and third and fourth openings are placed at positions 80. Stitching may be used about the face opening and/or a neck opening as may be desired.

Figure 5:
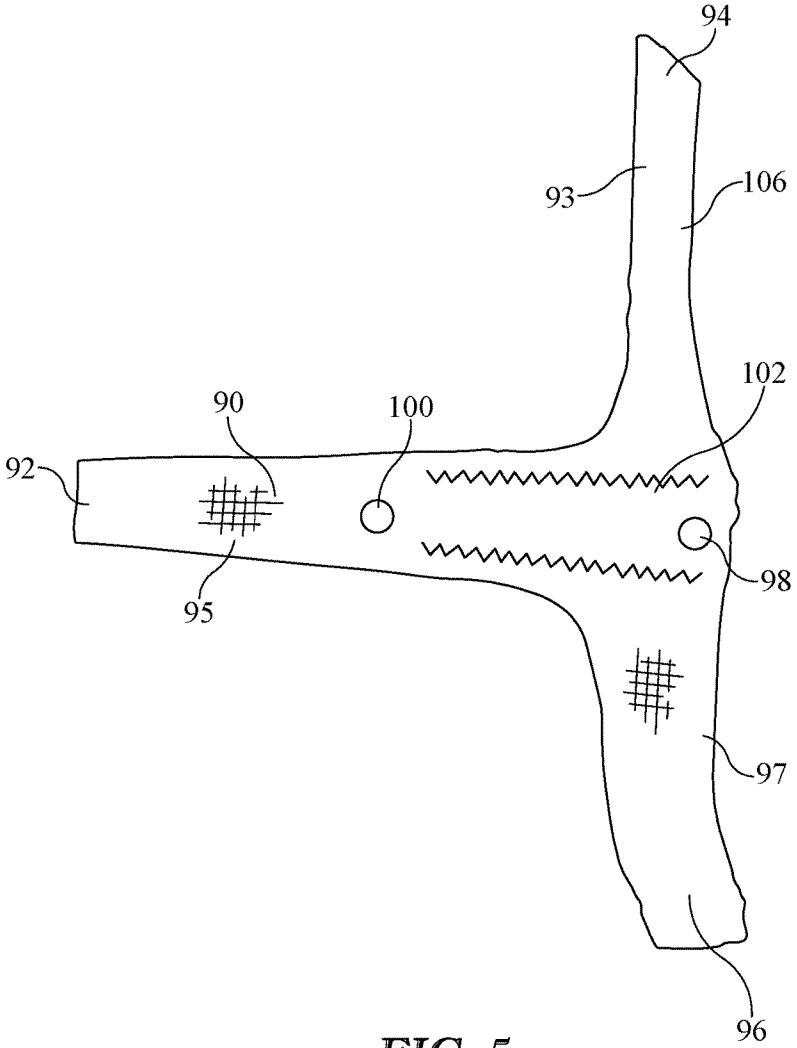
FIG. 5 is a side view of a further embodiment of the headgear of the present disclosure.

FIG. 5 shows a side view of headgear 90 of the present disclosure. Headgear 90 may comprise a stretchable material with a face opening 106. Headgear 90 may have a first portion 96 for extending under the chin, a second portion 94 for extending about an upper and/or forward portion of the head, and a third portion 92 for extending about a lower and/or reward portion of the head. For example, a strap like extension 97 may be configured and disposed to extend about the chin, strap like portion 93 may be configured and disposed to extend about an upper and/or forward portion of the head, and strap like portion 95 may be configured and disposed to extend about a lower and/or reward portion of the head.

Temple opening 98 and opening 100 may be configured and disposed to receive a temple of eyeglasses. For example, a temple of eyeglasses may be extended into temple opening 98 and out of opening 100. Sleeve 102 is optional and may be configured and disposed hold the portion of the temple of the eyeglasses that extends through temple opening 98 and opening 100. Stitching may be used about edges of headgear 90.

Figure 6:
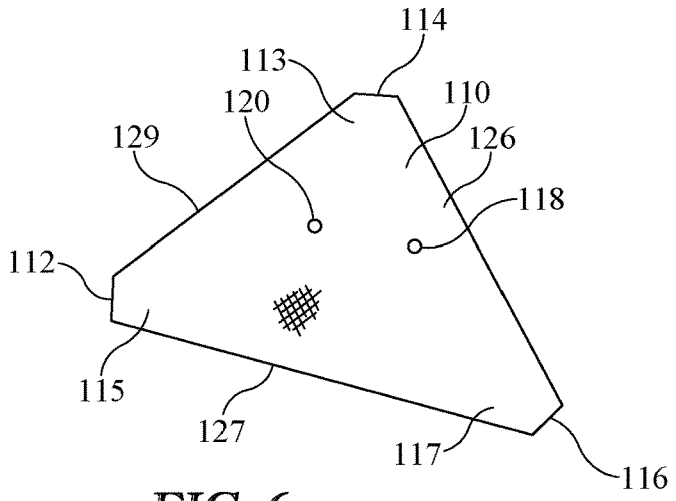
FIG. 6 is a side view of an embodiment of the headgear of the present disclosure.

FIG. 6 shows a side view of headgear 110 of the present disclosure. Headgear 110 may comprise a stretchable material with a face opening 126. Headgear 110 may have a portion 116 for extending under the chin, a portion 114 for extending about an upper and/or forward portion of the head, and a portion 112 for extending about a lower and/or reward portion of the head. For example, portion 117 may be configured and disposed to extend about the chin, portion 113 may be configured and disposed to extend about an upper and/or forward portion of the head, and portion 115 may be configured and disposed to extend about a lower and/or reward portion of the head. Headgear 110 may have a neck opening defined with edges 127. Headgear 110 may have a rear opening defined with edges 129. A rear opening may be desired to allow for hair to extend out of headgear 110. For example, headgear 110 may have rear opening 129 between second extending portion 113 and third extending portion 115, rear opening 129 may be configured and disposed to receive hair.

Temple opening 118 and opening 120 may be configured and disposed to receive a temple of eyeglasses. For example, a temple of eyeglasses may be extended into temple opening 118 and out of opening 120. Stitching may be placed about edges of headgear 110 as may be desired.

Figure 7:
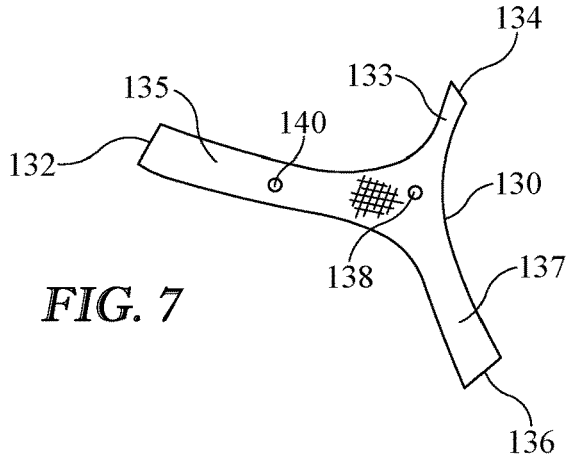
FIG. 7 is a side view of another embodiment of the headgear of the present disclosure.

FIG. 7 shows a side view of headgear 130 of the present disclosure. Headgear 130 may comprise a stretchable material. Headgear 130 may have a portion 136 for extending under the chin, a portion 134 for extending about an upper and/or forward portion of the head, and a portion 132 for extending about a lower and/or reward portion of the head. For example, strap like portion 137 may be configured and disposed to extend about the chin, a strap like portion 133 may be configured and disposed to extend about an upper and/or forward portion of the head, and strap like portion 135 may be configured and disposed to extend about a lower and/or reward portion of the head. Temple opening 138 and opening 140 may be configured and disposed to receive a temple of eyeglasses. For example, a temple of eyeglasses may be extended into temple opening 138 and out of opening 140. Stitching may be placed about edges of headgear 130 as may be desired.

Figure 8:
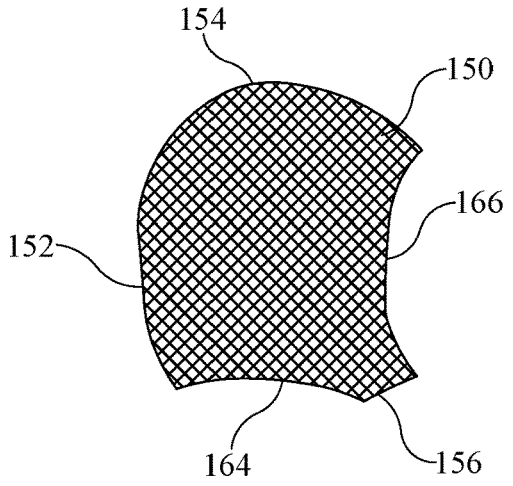
FIG. 8 is a side view of a further embodiment of the headgear of the present disclosure.
Figure 9:
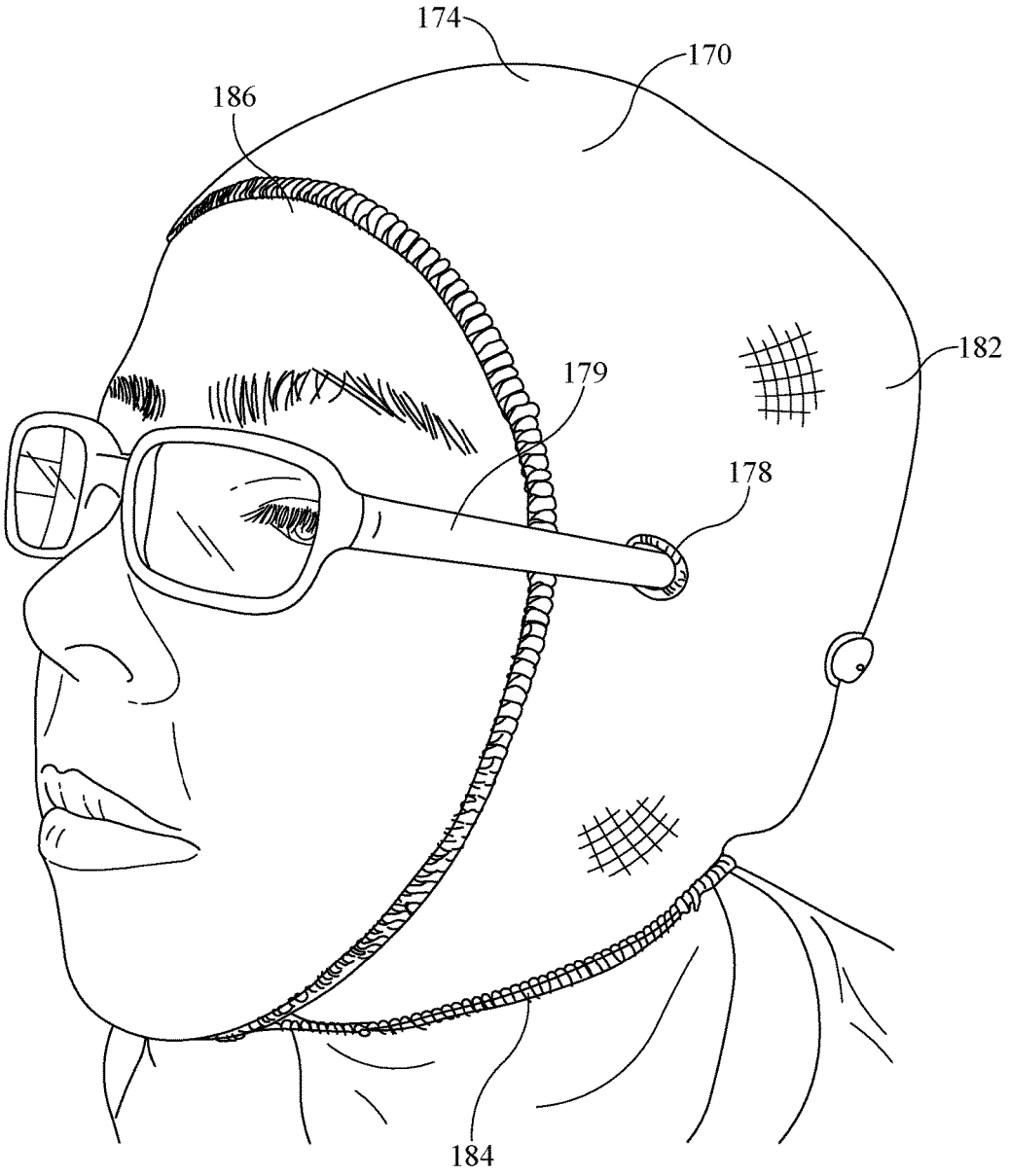
FIGS. 9-12 show perspective views of headgear of the present disclosure being worn by a wearer and the positioning of spectacles.
Figure 10:
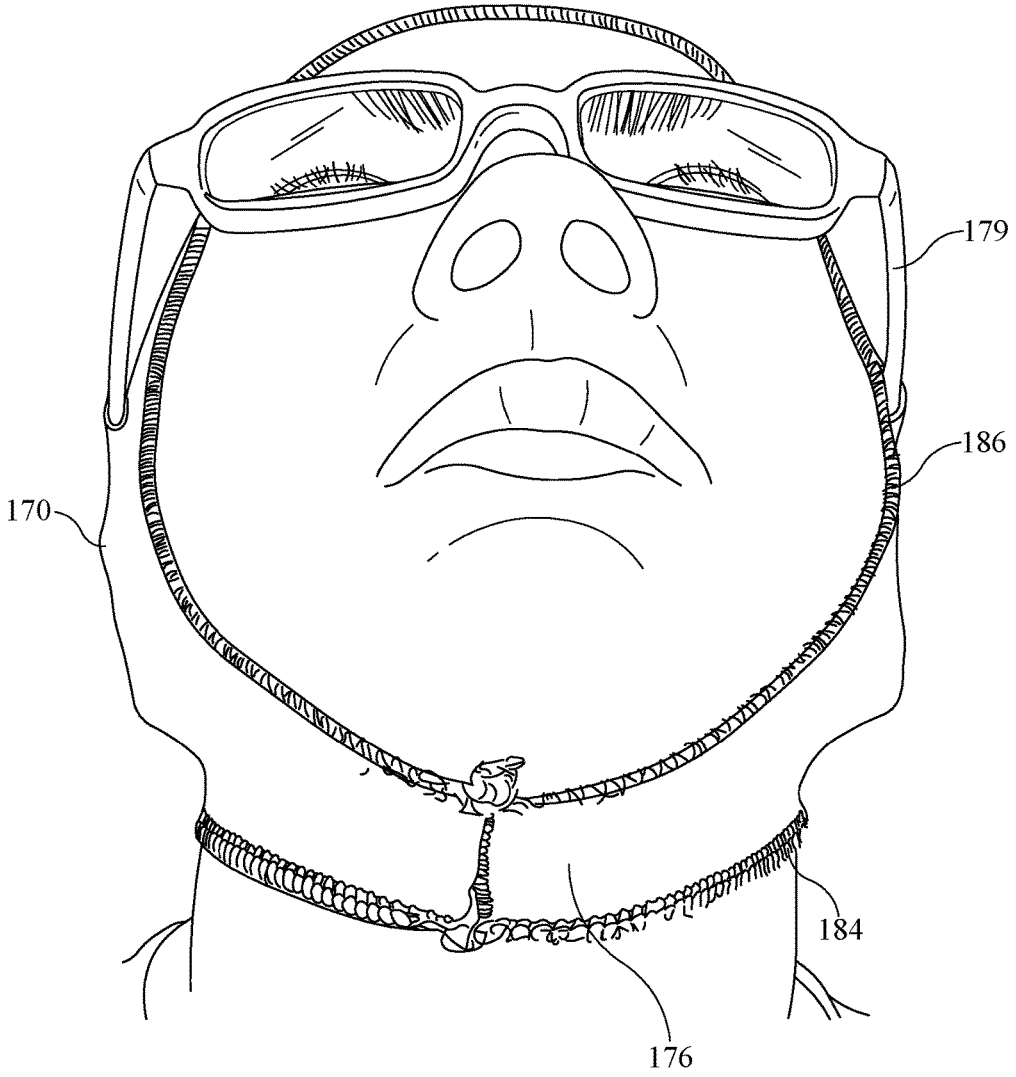

FIG. 8 shows a side view of headgear 150 of the present disclosure. Headgear 150 may comprise a net like or perforated stretchable material. Headgear 150 may have a portion 156 for extending under the chin, a portion 154 for extending about an upper and/or forward portion of the head, and a portion 152 for extending about a lower and/or reward portion of the head. Portions 154 and 152 may be continuously joined to form headgear 150 that may be wrapped about the head and have face opening 166 and neck opening 164. A plurality of temple openings and other opening configured and disposed to receive a temple of eyeglasses may be provided with the net like or perforated material. For example, a temple of eyeglasses may be extended into temple a first opening and out of a second opening. Additionally, a temple of glasses may be passed into and out of a plurality of openings which may impart a desired holding function to headgear 150.

FIGS. 9-12 show perspective views of headgear 170 being worn and positioning spectacles. Headgear 170 may comprise a stretchable material with a face opening 186 and a neck opening 184. Headgear 170 may have a portion 176 for extending under the chin, a portion 174 for extending about an upper and/or forward portion of the head, and a portion 182 for extending about a lower and/or reward portion of the head. Temple opening 178 and rear openings 180 are shown receiving a temple 179 of eyeglasses. For example, a temple 179 extends into temple opening 178 and out of rear opening 180.

A method for positioning and holding spectacles on the head is presently disclosed. The method comprises extending a first temple into a first opening in headgear configured to be held on the head and extending a second temple into a second opening in the headgear. The headgear may be stretched and slid onto the head and the face opening may be positioned about the face and each temple positioned proximate an ear.

Figure 11:
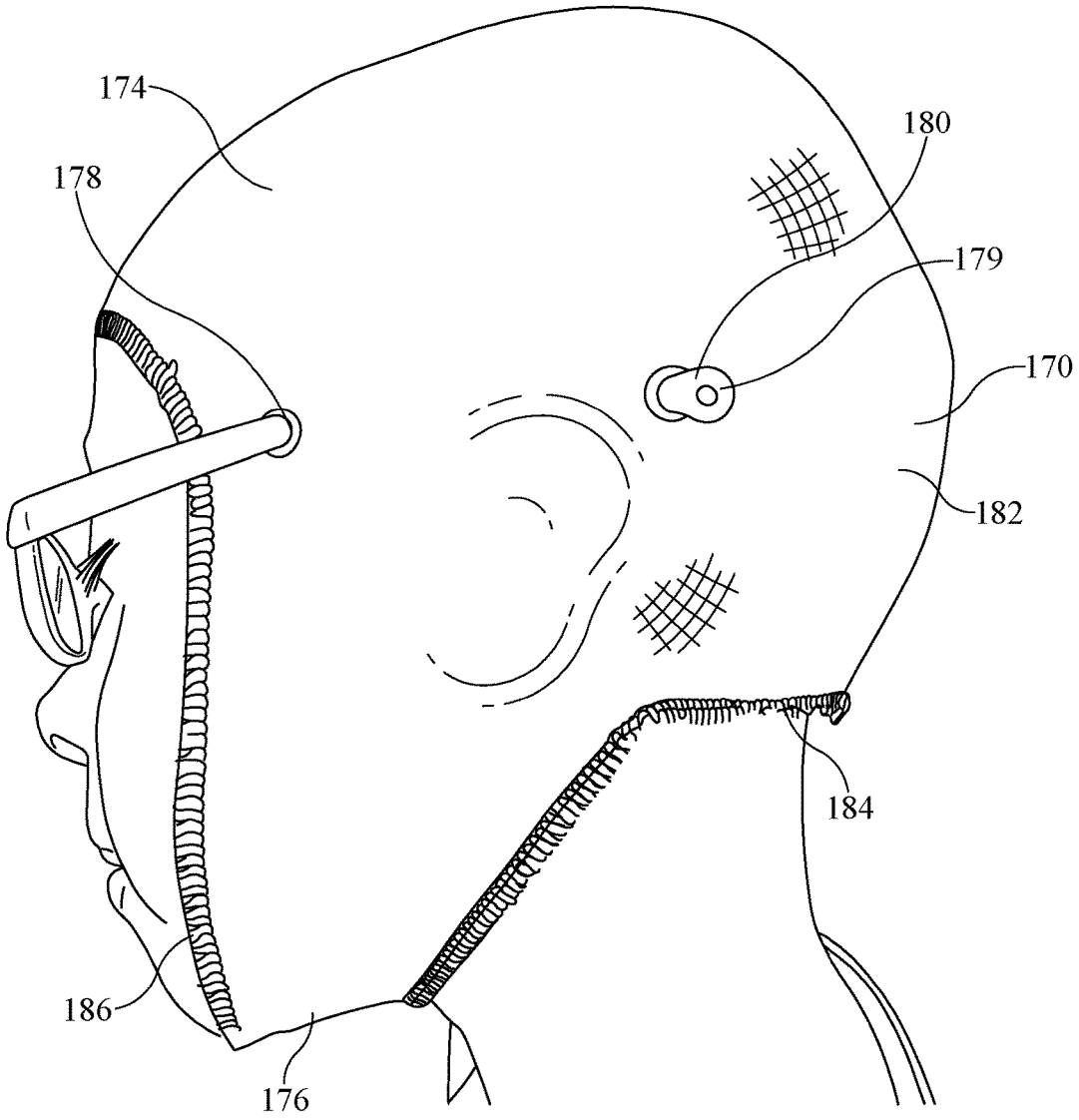
Figure 12:
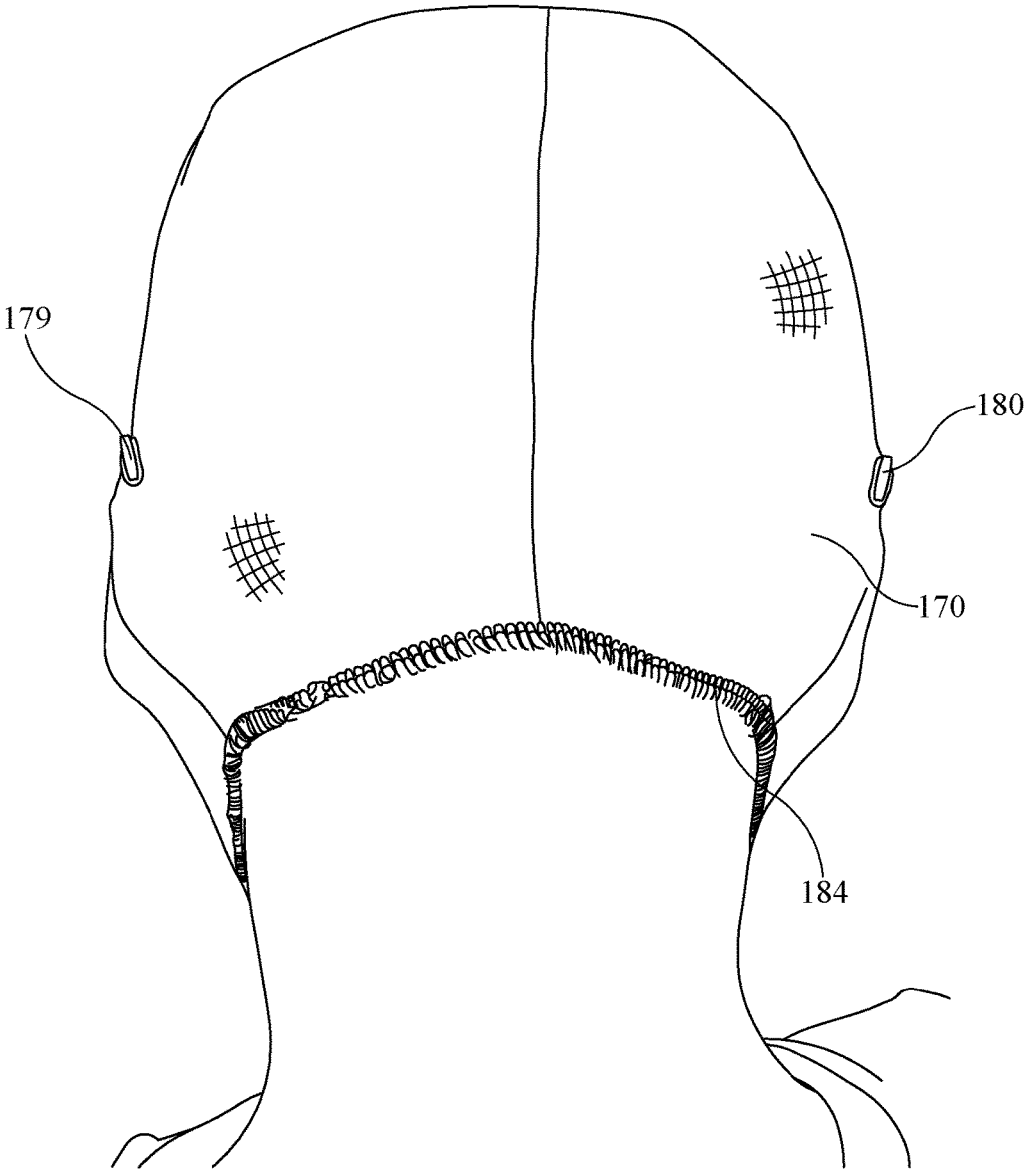

The temples may be extended out of third and fourth openings, as shown in FIG. 11. extending the first temple into a third opening. The headgear may be taken off of the head and slid back onto the head, wherein the spectacles may remain held with the headgear while the headgear is off the head.

There is thus provided a headgear for positioning spectacles on a wearer and method for positioning glass on a wearer. One feature or aspect of an illustrative example is believed at the time of the filing of this patent application to possibly reside broadly in headgear configured for positioning of spectacles comprising: a first extending portion configured to extend under a chin; a second extending portion configured for extending about a forward portion of a head; a third extending portion configured for extending about a reward portion of the head; a first opening in the second extending portion or third extending portion; a second opening in the second extending portion or third extending portion; the first opening being configured and disposed to receive a first eyeglass temple on a first side of the head; and the second opening being configured and disposed to receive a second eyeglass temple on a second side of the head.

Another feature or aspect of an illustrative example is believed at the time of the filing of this patent application to possibly reside broadly in headgear comprising a third opening and a fourth opening, the third opening being spaced apart from the first opening and configured and disposed to receive the first eyeglass temple on the first side of the head and the fourth opening being spaced apart from the second opening and configured and disposed to receive the second eyeglass temple on the second side of the head.

Yet another feature or aspect of an illustrative example is believed at the time of the filing of this patent application to possibly reside broadly in headgear, wherein the first opening and the third opening are spaced apart a distance less than a length of the first eyeglass temple and the second opening and the fourth opening are spaced apart a distance less than a length of the second eyeglass temple.

Still another feature or aspect of an illustrative example is believed at the time of the filing of this patent application to possibly reside broadly in headgear, wherein the first opening and the third opening are configured and disposed to hold the first eyeglass temple proximate a first ear and the second opening and the fourth opening are configured and disposed to hold the second eyeglass temple proximate a second ear.

A further feature or aspect of an illustrative example is believed at the time of the filing of this patent application to possibly reside broadly in headgear, wherein the first extending portion, the second extending portion, and the third extending portions are unitary and comprised of the same material.

Another feature or aspect of an illustrative example is believed at the time of the filing of this patent application to possibly reside broadly in headgear, wherein the material is stretchable.

Yet another feature or aspect of an illustrative example is believed at the time of the filing of this patent application to possibly reside broadly in headgear, wherein the material is a four way stretch fabric.

Still another feature or aspect of an illustrative example is believed at the time of the filing of this patent application to possibly reside broadly in headgear, wherein the material is breathable.

A further feature or aspect of an illustrative example is believed at the time of the filing of this patent application to possibly reside broadly in headgear comprising a face opening between the first extending portion and the second extending portion and a neck opening between the first extending portion and the third extending portion.

Another feature or aspect of an illustrative example is believed at the time of the filing of this patent application to possibly reside broadly in headgear comprising a rear opening between the second extending portion and the third extending portion, the rear opening being configured and disposed to receive hair.

Yet another feature or aspect of an illustrative example is believed at the time of the filing of this patent application to possibly reside broadly in a method for positioning and holding spectacles on the head comprising the steps of: extending a first temple into a first opening in headgear configured to be held on the head; extending a second temple into a second opening in the headgear; sliding the headgear onto the head and positioning a face opening about a face and each temple proximate an ear.

One feature or aspect of an illustrative example is believed at the time of the filing of this patent application to possibly reside broadly in the method further comprising the steps of: extending the first temple into a third opening; and extending the second temple into a fourth opening.

Another feature or aspect of an illustrative example is believed at the time of the filing of this patent application to possibly reside broadly in the method further comprising sliding the headgear off of the head and sliding the headgear back onto the head, wherein the spectacles remain held with the headgear while the headgear is off the head.

Yet another feature or aspect of an illustrative example is believed at the time of the filing of this patent application to possibly reside broadly in headgear configured for maintaining positioning, or inducing repositioning, of spectacles at a desired orientation on a wearer comprising: a stretchable breathable material; a neck opening configured to enlarged by an amount sufficient for sliding the wearers head therein; a face opening configured and disposed to extend about the wearer's face upon the wearer sliding their head into the neck opening; a first temple opening configured to receive a first temple; a second temple opening configured to receive a second temple; and the first and the second temple openings being configured and disposed for positioning the spectacles at a desired orientation on the wearer.

Still another feature or aspect of an illustrative example is believed at the time of the filing of this patent application to possibly reside broadly in the headgear further comprising: a third temple opening configured to receive the first temple; and a fourth temple opening configured to receive the second temple.

A further feature or aspect of an illustrative example is believed at the time of the filing of this patent application to possibly reside broadly in the headgear being configured to induce the wearer to reposition the headgear and spectacles to a desired orientation upon the headgear and spectacles being positioned at an undesired orientation.

Another feature or aspect of an illustrative example is believed at the time of the filing of this patent application to possibly reside broadly in the headgear of being configured to become skin tight on the wearer's head.

Yet another feature or aspect of an illustrative example is believed at the time of the filing of this patent application to possibly reside broadly in the headgear, wherein the first and the third temple openings are configured and disposed to hold the first temple above and proximate an ear and the second and the fourth temple openings are configured and disposed to hold the second temple above and proximate the other ear.

Still another feature or aspect of an illustrative example is believed at the time of the filing of this patent application to possibly reside broadly in headgear further comprising a rear opening configured and disposed for hair to extend out of the headgear.

A further feature or aspect of an illustrative example is believed at the time of the filing of this patent application to possibly reside broadly in the headgear comprising a chin strapping portion configured to extend about a chin, a forward strapping portion configured to extend about a forehead, and a rearward strapping portion configured to extend about the rear of the head.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. Headgear configured for positioning of spectacles comprising:

a first extending portion configured to extend under a chin;

a second extending portion configured for extending about a forward portion of a head;

a third extending portion configured for extending about a reward portion of the head;

a first opening in the second extending portion or third extending portion;

a second opening in the second extending portion or third extending portion;

a third opening in the second extending portion or third extending portion and spaced apart from the first opening;

a fourth opening in the second extending portion or third extending portion and spaced apart from the second opening;

the first opening and the third opening being configured and disposed to receive a first eyeglass temple on a first side of the head; and the second opening and the fourth opening being configured and disposed to receive a second eyeglass temple on a second side of the head.

2. The headgear of claim 1, wherein the first opening and the third opening are spaced apart a distance less than a length of the first eyeglass temple and the second opening and the fourth opening are spaced apart a distance less than a length of the second eyeglass temple.

3. The headgear of claim 2, wherein the first opening and the third opening are configured and disposed to hold the first eyeglass temple proximate a first ear and the second opening and the fourth opening are configured and disposed to hold the second eyeglass temple proximate a second ear.

4. The headgear of claim 1, wherein the first extending portion, the second extending portion, and the third extending portions are unitary and comprised of the same material.

5. The headgear of claim 4, wherein the material is stretchable.

6. The headgear of claim 5, wherein the material is a four way stretch fabric.

7. The headgear of claim 4, wherein the material is breathable.

8. The headgear of claim 1 comprising a face opening between the first extending portion and the second extending portion and a neck opening between the first extending portion and the third extending portion.

9. The headgear of claim 1 comprising a rear opening between the second extending portion and the third extending portion, the rear opening being configured and disposed to receive hair.

10. A method for positioning and holding spectacles on the head comprising the steps of:

extending a first temple through a first opening and a third opening in headgear configured to be held on the head;

extending a second temple through a second opening and a fourth opening in the headgear;

sliding the headgear on the head and positioning a face opening about a face and each temple proximate an ear.

11. The method of claim 10 further comprising sliding the headgear off of the head and sliding the headgear back onto the head, wherein the spectacles remain held with the headgear while the headgear is off the head.

12. Headgear configured for maintaining positioning, or inducing repositioning, of spectacles at a desired orientation on a wearer comprising:

a stretchable breathable material;

a neck opening configured to be enlarged by an amount sufficient for sliding the wearers head therein;

a face opening configured and disposed to extend about the wearer's face upon the wearer sliding their head into the neck opening;

a first temple opening configured to receive a first temple;

a second temple opening configured to receive a second temple;

a third temple opening configured to receive the first temple;

a fourth temple opening configured to receive the second temple; and the first and the second temple openings being configured and disposed for positioning the spectacles at a desired orientation on the wearer.

13. The headgear of claim 12 being configured to induce the wearer to reposition the headgear and spectacles to a desired orientation upon the headgear and spectacles being positioned at an undesired orientation.

14. The headgear of claim 12 configured to become skin tight on the wearer's head.

15. The headgear of claim 12, wherein the first and the third temple openings are configured and disposed to hold the first temple above and proximate an ear and the second and the fourth temple openings are configured and disposed to hold the second temple above and proximate the other ear.

16. The headgear of claim 12 further comprising a rear opening configured and disposed for hair to extend out of the headgear.

17. The headgear of claim 12 comprising a chin strapping portion configured to extend about a chin, a forward strapping portion configured to extend about a forehead, and a rearward strapping portion configured to extend about the rear of the head.

* * * * *